United States Patent [19]

Fiehler

[11] Patent Number: 4,688,364

[45] Date of Patent: Aug. 25, 1987

[54] CONSTRUCTION SYSTEM AND COMPONENTS THEREFOR

[76] Inventor: Raymond Fiehler, 904 Utah Ave., St. Louis, Mo. 63118

[21] Appl. No.: 931,923

[22] Filed: Nov. 14, 1986

Related U.S. Application Data

[63] Continuation of Ser. No. 728,345, Apr. 29, 1985, abandoned.

[51] Int. Cl.[4] ..... E04B 1/68

[52] U.S. Cl. ..... 52/573; 52/585; 52/595; 52/606

[56] References Cited

U.S. PATENT DOCUMENTS

| | | | |
|---|---|---|---|
| 749,812 | 1/1904 | Buente | 52/437 X |
| 2,244,343 | 6/1941 | Meyercord | 52/585 |
| 2,328,823 | 9/1943 | MacKenzie | 52/585 X |
| 3,204,381 | 9/1965 | Perreton | 52/606 X |
| 3,378,969 | 4/1968 | Larger | 52/396 X |
| 4,104,885 | 8/1978 | Thomas | 52/585 X |
| 4,320,612 | 3/1982 | Jeffries, Jr. | 52/595 X |

*Primary Examiner*—Carl D. Friedman

*Attorney, Agent, or Firm*—Kalish & Gilster

[57] ABSTRACT

A construction system for wall formation comprising a plurality of block forming units, said units being arranged in vertical, side-by-side rows, with endwise abutment between adjacent rows of said units, positively interengaging components provided on the confronting ends of the units, adhesion between the units of one row and those of each adjacent row being effected by cementitious material, and wall expanding and contracting units provided within said wall formation; each of said last-mentioned units incorporating first and second cooperative members adapted for mutual relative horizontal movement responsive to atmospheric conditions.

5 Claims, 5 Drawing Figures

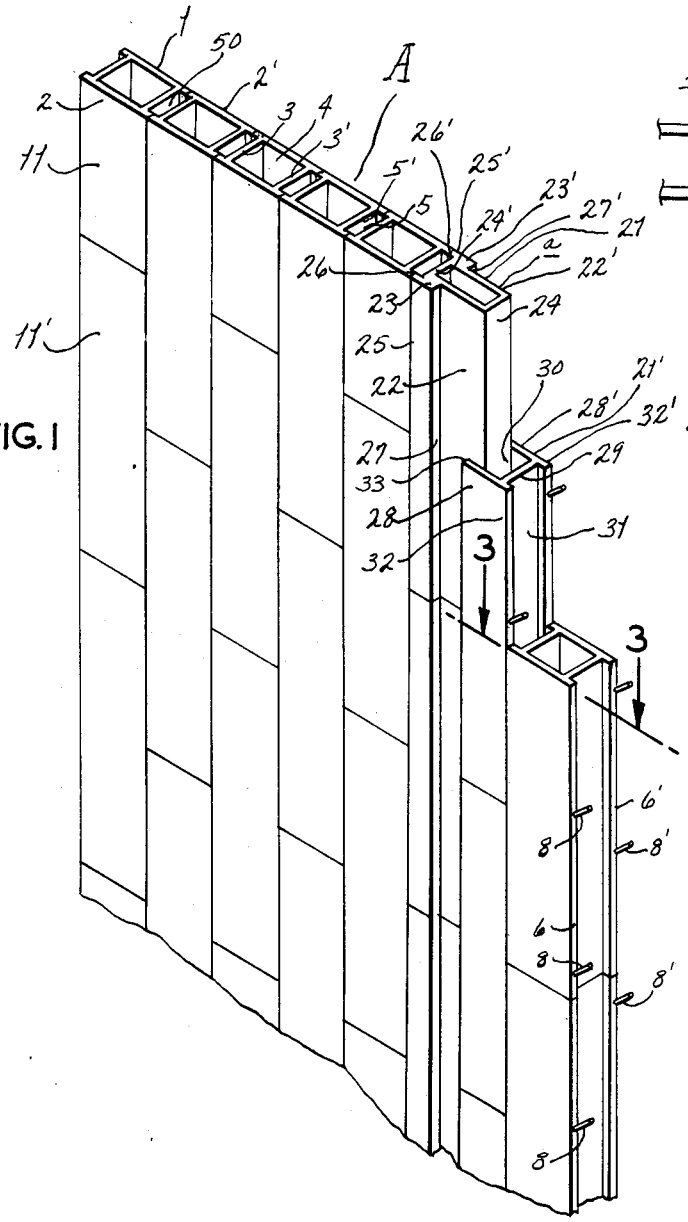
FIG. 1
FIG. 2
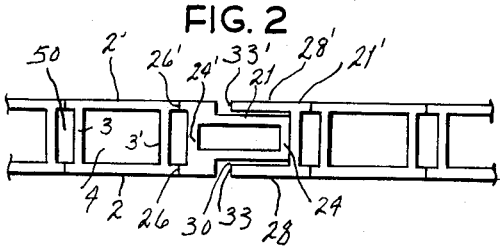
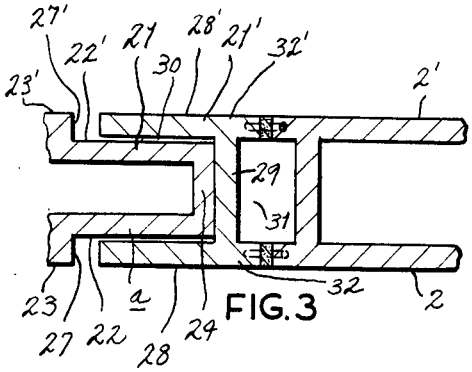
FIG. 3
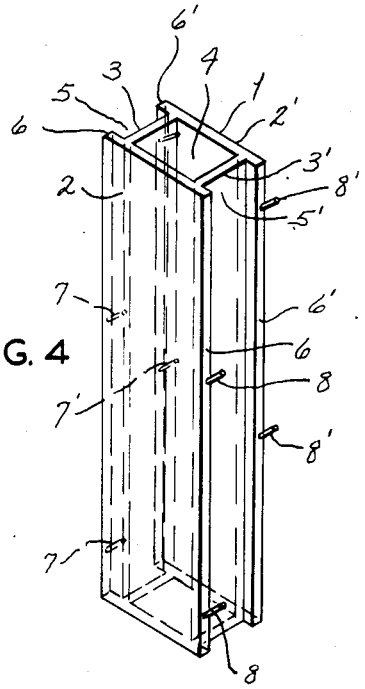
FIG. 4
FIG. 5
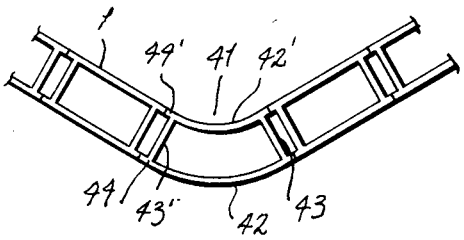

CONSTRUCTION SYSTEM AND COMPONENTS THEREFOR

This application is a continuation of application Ser. No. 728,345, now abandoned.

BACKGROUND AND SUMMARY OF THE INVENTION

This invention relates in general to building constructions and, more particularly, to a unique improved system for wall construction.

In view of the ever-escalating costs of construction for both residential and commercial purposes, there is an ongoing effort in the industry to develop systems which may be relatively economically effected but without loss of sturdiness, wall integrity, and safety. The present invention contemplates development of building walls through cooperation of discrete block-like units which are designed for facile integration, the interengagement of which can be readily accomplished by the average, unskilled individual. Thus, the present invention obviates the necessity of costly carpenter and mason services since the conventional stud in panel and brick and concrete block types of construction are obviated.

Therefore, it is an object of the present invention to provide a system for wall construction incorporating preformed components which may be easily interengaged for creating a safe and sturdy structure suitable for industrial and residential usage.

It is another object of the present invention to provide a system of the character stated wherein the components may, if desired, be designed to provide voids for receiving insulation or strength-enhancing agents, at the election of the builder.

It is a further object of the present invention to provide a system of the character stated which incorporates components adapted to permit facile expansion and contraction of the structure responsive to atmospheric conditions.

It is a still further object of the present invention to provide a system of the character stated which is productive with equal facility of both planar and arcuate or circular walls, as desired, so that such system is extremely versatile, thereby allowing of an escape from the widespread practice of producing what might be referred to as 'square' constructions.

It is another object of the present invention to provide a system of the character stated which is adapted to permit easy readjustment in vertical alignment when necessary during construction.

It is a still further object of the present invention to provide a system of the character stated which is productive of wall constructions of marked durability in usage as well as promoting most substantial economies in both labor and material for construction purposes.

FIG. is a fragmentary perspective view of a planar wall constructed in accordance with and embodying the present invention.

FIG. 2 is a fragmentary top view illustrating the expansion joint adjacent structure.

FIG. 3 is a horizontal transverse sectional view taken along the line 3—3 of FIG. 1.

FIG. 4 is a perspective view of a construction base unit.

FIG. 5 is a fragmentary top view of an arcuate wall constructed in accordance with and embodying the present invention.

DESCRIPTION OF THE PRACTICAL EMBODIMENTS

Referring now by reference characters to the drawings which illustrate practical embodiments of the present invention, A generally designates a wall formation , or what may be termed simply a wall, of planar configuration comprised of integrated unitary blocks 1 of a first type. Blocks 1 are shown herein as being of hollow or void-developing shape but may if desired be solid. However, the hollow shape does conduce to greater ease in handling and thus will be described herein for exemplary purposes. Each block 1 contains parallel side walls 2, 2' , the former being considered as being directed inwardly and hence being a constituent of the inner face of wall A. Adjoining said side walls 2, 2' are parallel end walls 3, 3' which thus cooperate with said side walls to define a central void 4 extending the length of block 1 of the vertical extent thereof when in operative condition. Said end walls 3, 3' are spaced inwardly from the adjacent end portions of side walls 2, 2' thereby defining with such projecting end portions generally U-shaped outwardly opening recesses 5, 5' , respectively. The sides of recesses 5, 5' are thus developed by the adjacent end projections of side walls 2, 2' as indicated at 6, 6' , respectively.

As may be evident from FIG. 1, blocks 1 are of preferably two different lengths as indicated at 11, 11' , so that when integrated into wall-formation the same will be arranged in offset or staggered relationship to the immediately adjacent blocks 1 for assuring of strength and collapse-resistance of wall A. As illustrated with wall A, blocks 1 are disposed in vertical rows with the blocks of length 11, 11' alternating with the alternation in any one row being opposed to that in immediately adjacent rows.

As indicated above, blocks 1 may be of any deired material of construction but it may be pointed out that a particularly suitable material, from one standpoint of economy and durability, is fibrous material as obtained from virgin or waste fibers; for instance, sawdust, to which may be added other waste materials as newsprint, rags, scrap carboard, etc., with the same being bound by a suitable adhesive and then formed through extrusion. But as indicated, this material of construction is not critical for the development of walls according to the present invention.

End projection 6, 6' at one end of each block 1 are provided spacedly lengthwise therealong with aperture as at 7, 7' , respectively, the bore of each of which progresses at a predetermined angle to the axis of the related end projection 6, 6' , preferably less than ninety degrees to the longitudinal axis of projections 6, 6' , and the opposed end projection 6, 6' each carry a series of pins 8, 8' , respectively, preferably of steel, which are disposed at an angle compatible with aperture 7, 7' and hence desirably less than 90 degrees to the related end projection and being of such length and diameter for snug, reliable reception within the aligned openings 7, 7' in the confronting end projections 6, 6' of the adjacent block 1, that is, the aligned one in the next adjacent vertical row.

Thus, in developing wall A it will be seen that vertical rows of alternating blocks 11, 11' will be formed and, as pointed out, with the alternating rows having the said blocks in opposed relationship to the contiguous rows for the purposes stated. In forming wall A, blocks 1 in one vertical row are interengaged to the blocks in the row adjacent one end through reception of the pins 8, 8' thereof within the compatible openings 7, 7' of the first adjacent row and with the openings 8, 8' at the other end of such blocks receiving the coordinating pins 7, 7' of the blocks of the second or other adjacent row. Thus, the pin and opening expedient assures of a positive interengagement between the blocks 1 in one row and those in the rows at either end thereof. It will be seen that by providing blocks 1 of different length, the requisite vertical alignment is readily achieved.

It will be further observed that the blocks 1 are so constructed and disposed that the end surfaces of the related end projections 6, 6' at each end will abut against the surfaces of the confronting end projections 6, 6' of the immediately adjacent block 1 thereby providing a lateral supportive contact between the rows of blocks 1. To assure against any inadvertent relative shifting, the contacting end surfaces of adjacent blocks are coated with a suitable adhesive or cementitious material such as, for instance, an epoxy. Thus, the blocks 1 of wall A are accordingly subjected to double securing means for reliable integration, that is, by the pin and opening system and by the interposition of adhesives.

In order to permit the developed wall A to have the capacity to expand or contract responsive to atmospheric conditions, there are provided independently constructed cooperating blocks 21, 21' which, irespectively of second and third types as will be shown, are designed for telescopic-like relationship for the purposes stated. Each block 21 comprises a central, basic portion a of generally rectangular configuration in cross section, having parallel side walls 22, 22' which are interconnected at the ends thereof by end walls 24, 24'. It will be seen that the minor dimension of portion of each block 21 is less than that of blocks 1, so that normally the side walls 22, 22' thereof would be withdrawn from flushwise relation to side faces 2, 2' of the proximate blocks 1. In one end portion of each block 21 the same is integrally enlarged to provide sections 23, 23' which extend from side walls 22, 22', respectively, to an extent so as to be surface-wise aligned with side walls 2, 2' of the adjacent block 1, as at 25, 25'. Such enlarged sections 23, 23' embody parallel endwise projections 26, 26', extending beyond end wall 24' for presenting the end surfaces of such projections 26, 26' abuttingly against the end surfaces of the confronting projection 6, 6' on the adjacent block. Such projections 26, 26' are provided with pins 8, 8' or openings 7, 7' as may be required for assuring of snug union with such adjacent block. It will be seen that the enlarged sections remote from projections 26 26' develop shoulders 27, 27' facing in the opposite direction. Cooperating blocks 21, 21' are of requisite lengths in order to coordinate with blocks 1 to prevent any diminution in wall strength.

Blocks 21' comprehend parallel side faces 28, 28' which are interconnected by a single transverse wall 29 eccentrically located with respect to said side walls 28, 28' so as to define a first, relatively deep endwise outwardly opening recess 30 directed toward block 21 and a second relatively shallow recess 31 endwise opening in the opposite direction. Recess 31 is developed by end projections 32, 32' which are of like character and extent as end projection 6, 6' on blocks 1, with such projections 32, 32' being suitably provided with openings 7, 7' or pins 8, 8', as may be required for securement to the adjacent blocks 1.

Blocks 21 are of such cross section that side walls 28, 28' are aligned with side walls 2, 2' of blocks 1 and with recesses 30 dimensioned for recessing the unenlarged portion of the associated blocks 21, that is the portion remote from the end bearing sections 23, 23'. The transverse dimension of recess 30 is slightly greater than that of the cross section of blocks 21 to permit relative movement therebetween, all as may best be seen in FIGS. 2 and 3. Thus, with blocks 21 being fully received within the associated recesses 30 the end surfaces as at 33, 33' of the sides 28, 28', respectively, of said recess will abut representing a condition of maximum contraction. Under a warm atmospheric ambience blocks 21' will thus be permitted to move relatively away from blocks 21 as the latter are anchored to the proximate row of blocks 1.

As shown in FIG. 5, the components of the present invention may be extruded or otherwise formed to be arcuated in cross section, as indicated at 41 in FIG. 5 wherein the side walls 42, 42' are suitably arcuately configured, with there being end walls 43, 43' spaced inwardly from the adjacent end projections 44, 44' which are in all respects structurally similar to end projections 6, 6' of blocks 1 hereinabove described. Accordingly, arcuated blocks will be interengaged with planar blocks or other coordinating arcuated blocks in the same manner as blocks 1 hereinabove described; facile utilization of the above-described pin and opening arrangement and the provision of an adhesive. Thus, it is readily apparent that the present invention is equally useful in the construction of walls of either circular form or incorporating rounded or arcuated portions.

As discussed hereinabove, blocks 1 when of hollow form contain a central void 4 within which may be packed insulation or, if desired, various strength-promoting devices for overall wall reinforcement and for support of overhead components. Additionally, the mating recesses provided by the confronting ends of adjacent blocks cooperate to define relatively narrow voids as at 50 which also conduces to the overall lightness of blocks 1 but without diminution of structural strength.

Thus, the construction system of the present invention is uniquely designed to conduce to the rapid, low-cost development of walls for private dwellings, as well as commercial establishments, and which involves the exercising of less than highly developed skills so that the average individual could quite reliably assemble the components to present a wall having the characteristics of that hereinabove described.

What is claimed is:

1. In a construction system for providing a wall formation permitting expansion or contraction responsive to atmospheric conditions, comprising a plurality of block-forming units of first, second and third types, the units being arranged in vertical side-by-side rows with endwise abutment between adjacent tows of the units within the wall formation, each of the first type units including parallel first and second side walls and parallel first and second end walls, the end walls of each first type unit being located spacedly inwardly from end surfaces of the side walls for developing an endwise opening recess defined by the proximate end wall and adjacent extended portions of the side walls, the end surfaces for each the side walls being thereby configured for aubtting against confronting end surfaces of adjacent first type units with the associated recesses forming a continuous vertical void, the end walls and side walls of each first type unit defining a single central continuous volume extending vertically throughout the first type unit, whereby superimposed first type units present a continuous vertical volume throughout the height of the wall formation, the side walls of each first, secoind and third type unit being of substantially greater vertical extent than width, each of the second type units having parallel first and second side walls and having at one end an end wall located spacedly inward from end surfaces of such first and second side walls for developing thereby a shallow endwise-opening recess between the second type units and an adjacent vertical row of first type units, the end surfaces for said one end ofthe side walls of each second type unit abutting against confronting end surfaces of the adjacent vergital row of first type units, each of the third type units having first and second side walls joined by a single transverse wall proximate one end and located spaced inward from end surfaces of such first and second side walls for developing thereby a shallow endwise-opening recess between the third type units and an adjacent vertical row row of first type units, the end surfaces for said one end of the side walls of each third type unit providing parallel endwise projections for abutting against confronting end surfaces of the adjacent vertical row of first type units, and first and second independent means for integrally interconnecting abutting end surfaces of first type units with corresponding surfaces of each row adjacent thereto, the improvement characterized by:

telescopic means within the wall formation for permitting expansion and contraction of the wall formation in a horizontal direction responsive to atmospheric conditions, formed by vertical rows of the first type units interrupted by a pair of adjacent vertical rows of second and third type unit and constituted by each of the second type type units including at its end opposite from the shallow recess thereof a block-forming horizontally elongated endwise projection defining a planar opposite end wall and planar sidewalls terminating inwardly from said opposite end wall in vertically extending shoulders constituted by opposite ends of side walls of each second type unit, and each of the third type units defining at its end opposite from the shallow recess thereof a relatively deep rectangular recess constituted by the first and second side walls and single transverse wall of the third type unit, the rectangular recess terminating in opposite end surfaces of the first and second side walls for telescopingly receiving a block-forming endwise projection of an adjacent second type unit.

2. In a construction system according to claim 1, and further characterized by each block-forming projection having a transverse minor dimension less than that of the first type units. and horizontal major dimension betwen the end walls, the transverse dimension of the rectangular recess being slightly greater than the transverse minor dimension of the block-forming projection but the depth of the rectangular recess being less thna the horizontal major dimension of the block-forming projection whereby opposite end surfaces of the first and second side walls are spaced from the shoulders but will abut against the shoulders responsive to changes of atmospheric conditions.

3. In a construction system according to claim 2, and further characterized by the planar opposite end wall of each second type unit bearing against the single transverse wall of an adjacent third type unit.

4. In a construction system according to claim 2, and further characterized by the first independent interconnecting means comprising adhesive or cementious material and the second independent interconnecting means comprising a pin-and-opening system.

5. In a construction system according to claim 4, and further characterized by the pin-and-opening system being constituted by pin elements projecting from end surfaces of block-forming units at an angle of less than 90° to the vertical, and complementarily inclined openings in end surfaces of adjacent block-forming units for receiving corresponding ones of the pin elements.

* * * * *

UNITED STATES PATENT AND TRADEMARK OFFICE

CERTIFICATE OF CORRECTION

PATENT NO. : 4,688,364

DATED : August 25, 1987

INVENTOR(S) : Raymond Fiehler

It is certified that error appears in the above-identified patent and that said Letters Patent is hereby corrected as shown below:

Claim 1, Col. 4, line 60, "tows" should be "rows";
Claim 1, Col. 5, line 1, "aubtting" should be "abutting";
Claim 1, Col. 5, line 9, "secoind" should be "second";
Claim 1, Col. 5, line 17, "ofthe" should be "of the";
Claim 1, Col. 5, line 18, "vergital" should be "vertical";
Claim 1, Col. 5, line 21, "spaced" should be "spacedly";
Claim 1, Col. 5, line 25, delete "row" (second occurrence);
Claim 1, Col. 5, line 39, "unit" should be "units";
Claim 1, Col. 5, line 40, delete "type" (second occurrence);
Claim 2, Col. 6, line 21, "thna" should be "than".

Signed and Sealed this

Twenty-ninth Day of December, 1987

*Attest:*

DONALD J. QUIGG

*Attesting Officer*

*Commissioner of Patents and Trademarks*